United States Patent [19]

Bachmann

[11] Patent Number: 4,590,780

[45] Date of Patent: May 27, 1986

[54] PROCESS AND APPARATUS FOR PRODUCING AT LEAST TWO FORGINGS ON A HOT-FORMING PRESS

[75] Inventor: Ernst Bachmann, Ettingen, Switzerland

[73] Assignee: Hatebur Umformmaschinen AG, Reinach, Switzerland

[21] Appl. No.: 688,264

[22] Filed: Jan. 2, 1985

Related U.S. Application Data

[63] Continuation of Ser. No. 433,083, Oct. 6, 1982, abandoned.

[51] Int. Cl.[4] ..... B21D 28/06; B21D 53/10

[52] U.S. Cl. ..... 72/328; 72/327; 72/334; 72/354; 29/148.4 R; 83/621

[58] Field of Search ..... 72/327–336, 72/339, 354, 356; 29/148.4 R; 83/621, 405

[56] References Cited

U.S. PATENT DOCUMENTS

| | | | |
|---|---|---|---|
| 1,387,638 | 8/1921 | Bingham | 29/148.4 R |
| 2,308,953 | 1/1943 | Brown | 72/327 |
| 2,913,811 | 11/1959 | Benson | 29/148.4 R |
| 3,336,117 | 8/1967 | Borello | 72/327 |
| 3,496,619 | 2/1970 | Constant | 29/148.4 R |
| 3,602,078 | 8/1971 | Schindler | 83/621 |
| 3,736,827 | 6/1973 | Hof | 83/621 |
| 3,968,674 | 7/1976 | Ishida | 72/334 |

FOREIGN PATENT DOCUMENTS

| | | | |
|---|---|---|---|
| 1940379 | 2/1970 | Fed. Rep. of Germany | 72/327 |
| 2064440 | 7/1972 | Fed. Rep. of Germany | 72/327 |
| 2535155 | 2/1976 | Fed. Rep. of Germany | 29/148.4 |
| 403474 | 10/1973 | U.S.S.R. | 72/327 R |

*Primary Examiner*—Daniel C. Crane
*Attorney, Agent, or Firm*—Ladas & Parry

[57] ABSTRACT

Starting from a pre-heated bar, there is sheared-off first a portion (41) which, in a first forming stage of the machine, is formed into a tier shaped pressed article. In the second forming stage, the pressed article is further formed so that it has an inner ring (J), an outer ring (A) arranged co-axially to this and a radial annular web (S) connecting the two rings (J,A). The sheared-off outer ring (44) is therefore ejected in the next to last stage, while in the last working stage the inner ring (45) separated from the outer ring is subjected to further working. This last working stage involves stamping out a waste piece (35) and shearing-off an annular web (38). It is also possible to carry out a forming operation in this last working stage to upset the remaining inner ring (22*a*). By means of this process which provides for the elimination of the finished outer ring (44) in the last working stage, the radial annular web (38) can be supported over its full cross-sectional surface during the shearing-off operation.

2 Claims, 18 Drawing Figures

PROCESS AND APPARATUS FOR PRODUCING AT LEAST TWO FORGINGS ON A HOT-FORMING PRESS

Figure 1:
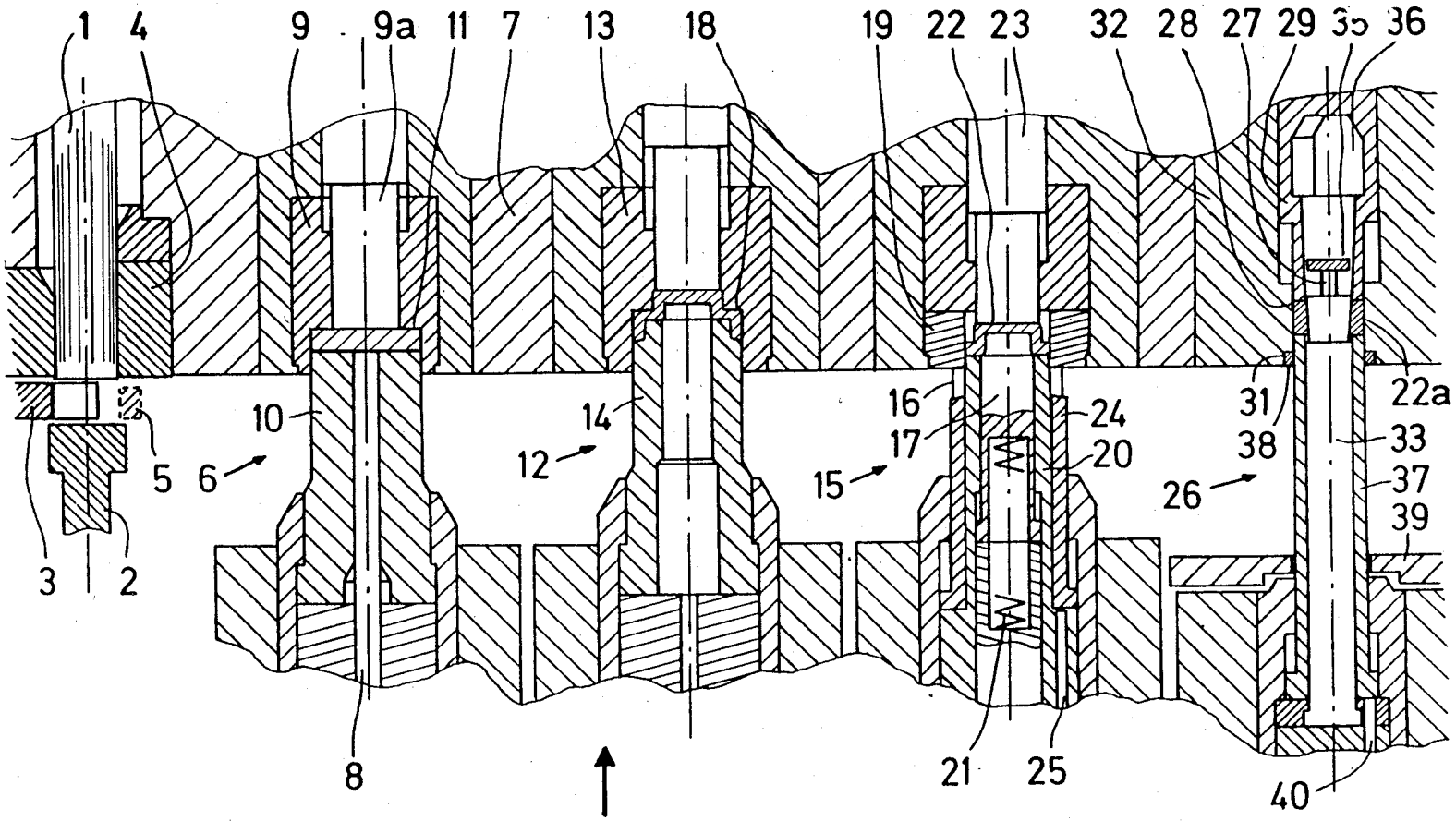
Figures 2A, 2B, 2C, 2D, 2E:
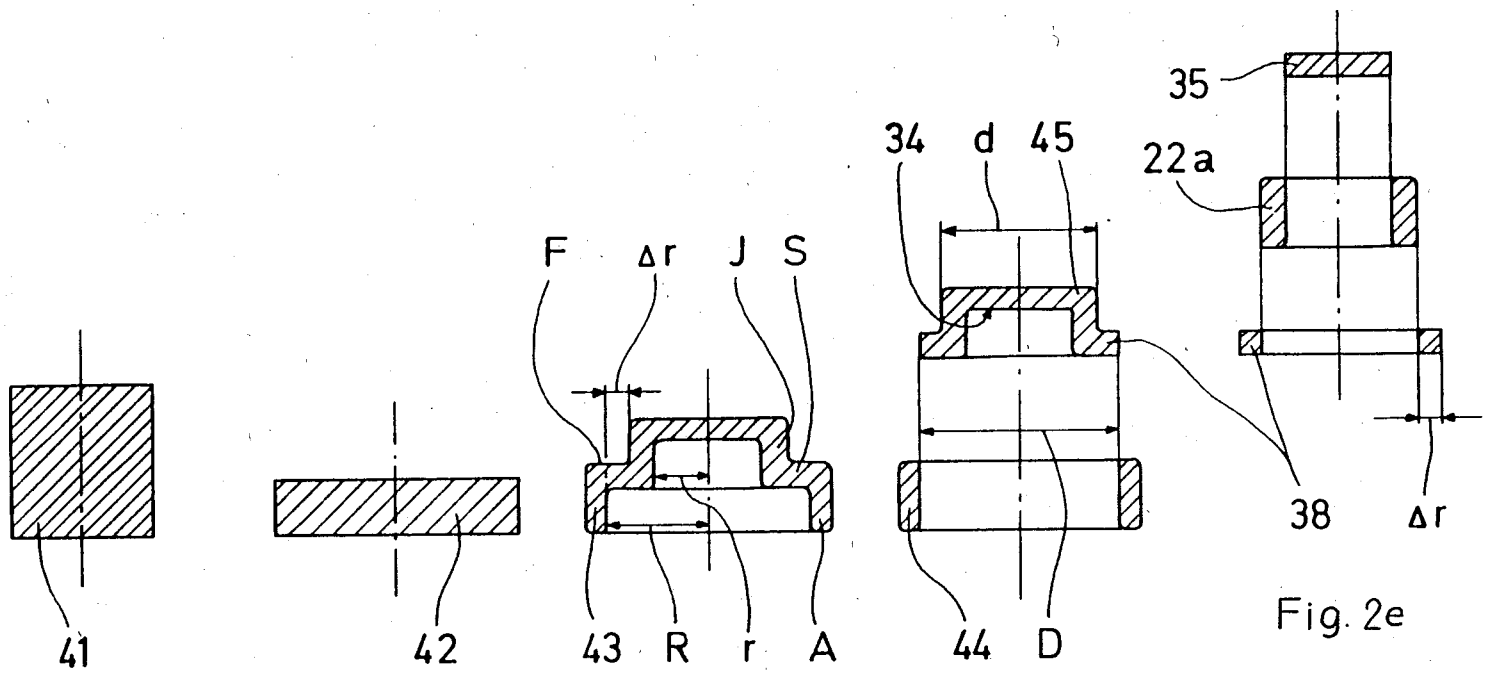

This is a continuation of co-pending application Ser. No. 433,083 filed on Oct. 6, 1982, now abandoned.

The present invention relates to a process for producing at least two forgings in a multi-stage work cycle on a hot-forming press, there being made first a pressed article which has at least two co-axial parts connected to one another by a radially extending annular web, that is to say an inner part and an outer part, of which at least the outer part having the greater outside diameter is annular, whereupon the parts are severed from one another in the region of the annular web by being sheared off and are ejected.

The innovation also relates to an apparatus for carrying out this process, which has in each stage a punch mounted to move to and fro and coupled to a drive, and a fixed die located co-axially opposite the punch, the punch having in the last stage but one an inner movably mounted retaining pin, an inner stamping punch and a stripper sleeve mounted to slide on its peripheral surface.

A process (as set forth in German Patent Specifications 1,940,379 and 2,064,440) involves producing two hollow bodies which fit into one another and which are severed from one another in the last working stage, with the bottom also being stamped out in the inner ring at the same time. Because the pressed article is severed only in the last working stage, the dimensions of the two rings are such that the inside diameter of the larger outer ring corresponds to the outside diameter of the smaller inner ring. During shearing-off, there arises on the outer surface of the inner ring and on the inner surface of the outer ring an annular extension which requires an additional operation on an automatic lathe to be eliminated.

A hot-forming press is known (Japanese Patent Specification No. 54-3477), in which a pressed article having an annular shoulder is dismembered into four parts, that is to say a waste piece, an inner ring, an outer ring and an intermediate ring. When the inner and outer rings are separated, the pressed article is supported by a movably mounted sleeve in that inner portion of the surface of the annular shoulder forming the intermediate ring which corresponds to the difference between the inside diameter of the outer ring and the outside diameter of the inner ring.

In this process, there are two fundamental difficulties which it has not been possible to eliminate by the methods known hitherto:

1. Since the above-mentioned difference in diameter is relatively small in many press moulds, that is to say may amount to only a few millimeters, the sleeve serving for support must also be made correspondingly thin-walled. However, the forces to be absorbed by this sleeve during shearing-off are so substantial that for reasons of strength the sleeve should not fall below a specific wall thickness. Because of this, however, the applicability of the severing process to the pressed articles to be severed is also severely restricted. In engineering and industry, there is a demand in many connections for parts in which the difference in diameter mentioned is relatively small and to which the known severing process is therefore not applicable. One of the adverse consequences of this process is that the rings severed from one another, that is to say, the inner ring and the outer ring, have at the point of separation, after being severed, a projecting annular extension which requires an additional operation on an automatic lathe.

2. There also arises, in the known process, the disadvantage that after being sheared off the inner ring has to be ejected from the machine in the direction of the ejector on the same side as the die. During this pushing-out operation, the parts, which are still hot, are to be pushed through a narrow channel, and the particular parts severed last push further those severed just beforehand. As has been shown in practice, it is unavoidable that parts butting constantly against one another should stick together, and that obstructions should occur, that is to say that there is no guarantee, in practice, that the parts will be transported away smoothly.

The object of the present innovation is, therefore, to propose a process and an apparatus, by means of which there is no need to use an inner-ring die dependent on the difference in diameter and which thus allows such parts with practically any small difference in area to be severed, and in which, also, ejection of the sheared-off inner ring in the direction of the ejector on the same side as the die will be avoided.

The present invention consists of a process for producing at least two forgings in a multi-stage work cycle on a hot-forming press by means of cooperating punch and die members. The process included the step of producing a pressed article which has at least two co-axial parts connected to one another by a radially extending annular web. The parts are an inner part and an outer part, of which at least the outer part, having the greater outside diameter, is annular. The parts are severed from one another in the region of the annular web by shearing. The outer part is first severed in a severing stage and is ejected as a finished part. Subsequently the inner part, including the radial annular web still attached to it, is transported into a further stage for additional processing. The improvement comprises the steps of simultaneously shearing off the radially extending annular web while its entire surface is in contact with the front face of a stationary die member and punching out a waste piece centrally located in the inner part. The annular web, inner part and waste piece are finally ejected along a direction of travel of the punch member.

Further, the invention consists of an apparatus for carrying out the process. The apparatus has in each stage a punch mounted for reciprocation and a fixed die located co-axially opposite the punch, the press possessing, in the next to last stage, an inner movably mounted retaining pin, an inner stamping punch and a stripper sleeve mounted to slide on its peripheral surface, wherein motion of the retaining pin, the stamping punch and the stripper sleeve are coordinated with one another so that, in this stage only, the annular outer part is severed and ejected as a finished part. The last stage of the fixed die comprises an annular supporting surface for the web and a movable bracing device, having a ring surface, corresponding to the outer ring. The punch is provided in its operating front face with a spring pin intended to puch the waste piece into the die after it has been severed from the inner ring.

The last stage of the process can be a pure forming stage or a pure stamping stage or can be designed as a combined stage in which stamping and forming are carried out.

This processing method makes it possible to reduce production costs and to achieve the best possible savings of material by the best possible joint forging of two or more parts which occur in the same quantities and the dimensions of which match one another.

An exemplary embodiment of the process according to the application, together with some alternative forms, is described below with reference to the attached drawing.

Figures 3A, 3B, 3C, 3D, 3E:
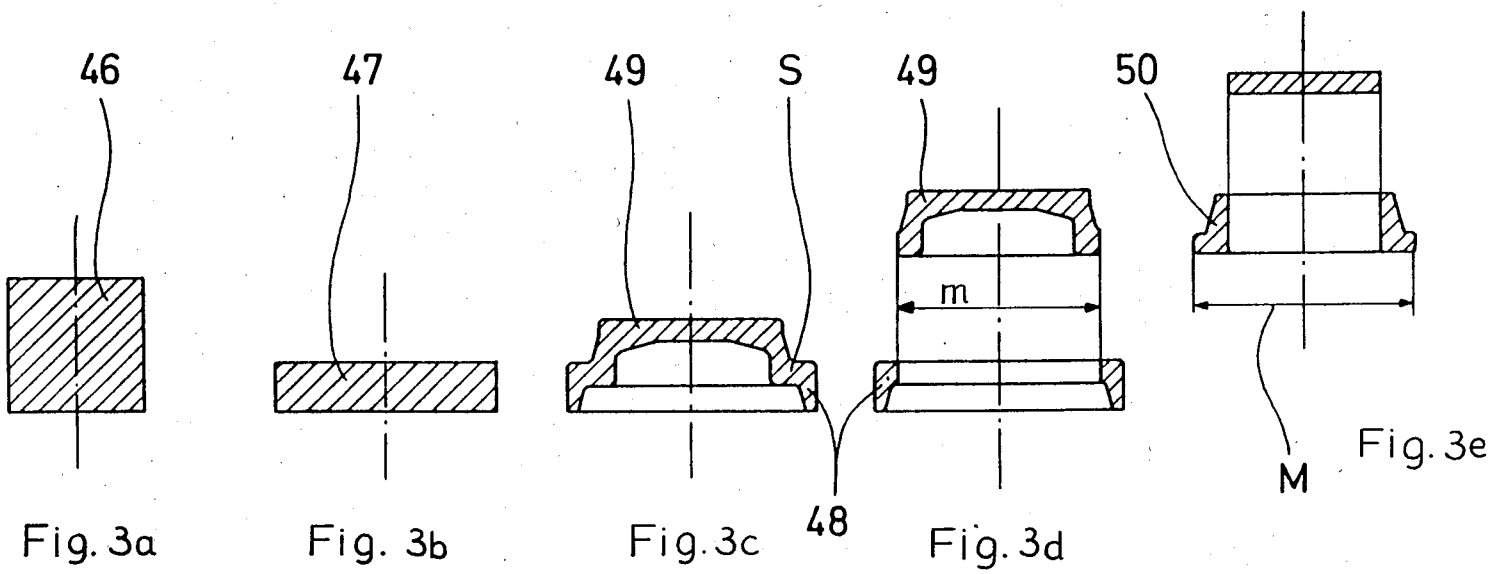
Figure 4:
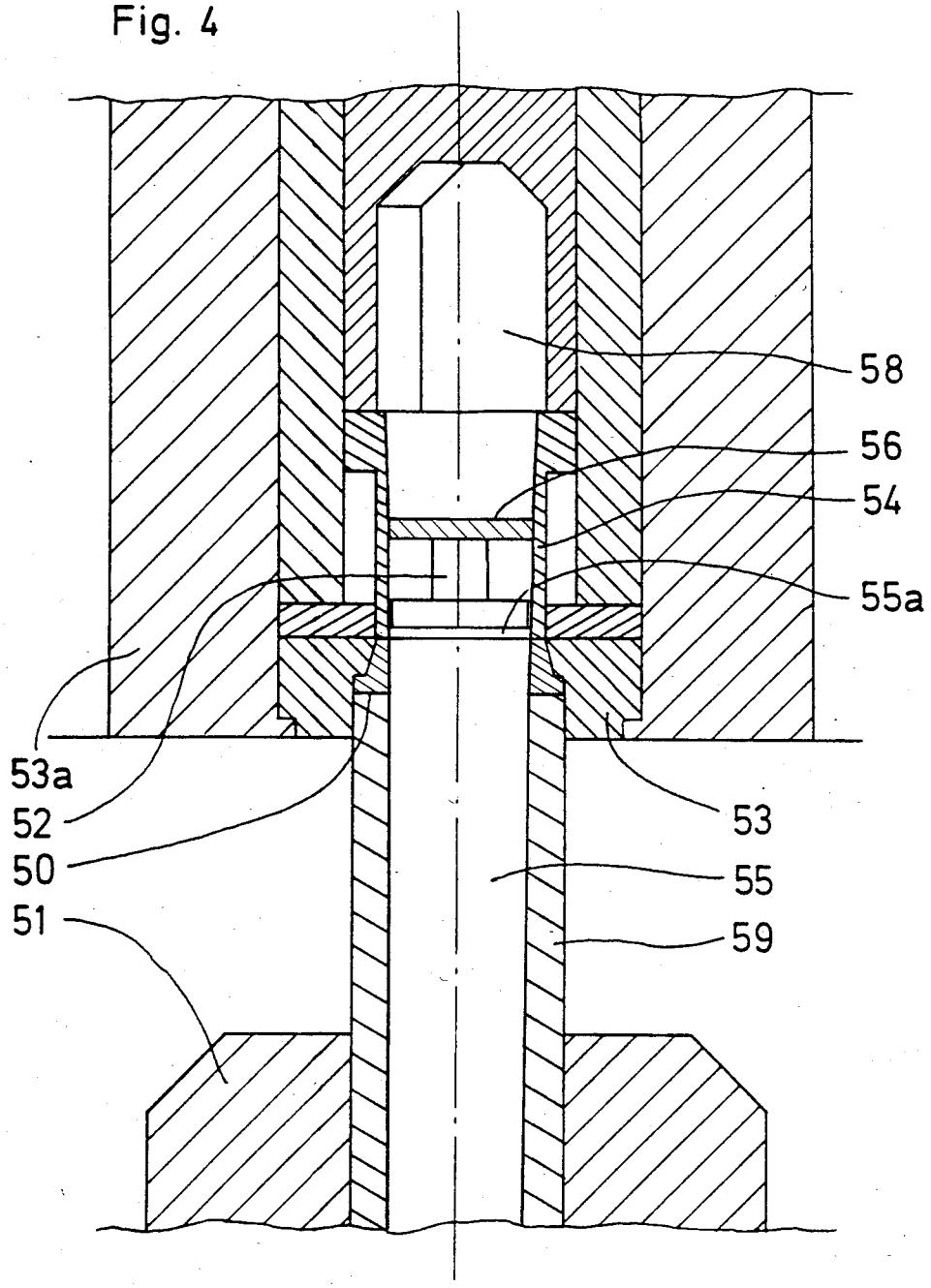
Figures 5A, 5B, 5C, 5D, 5E:
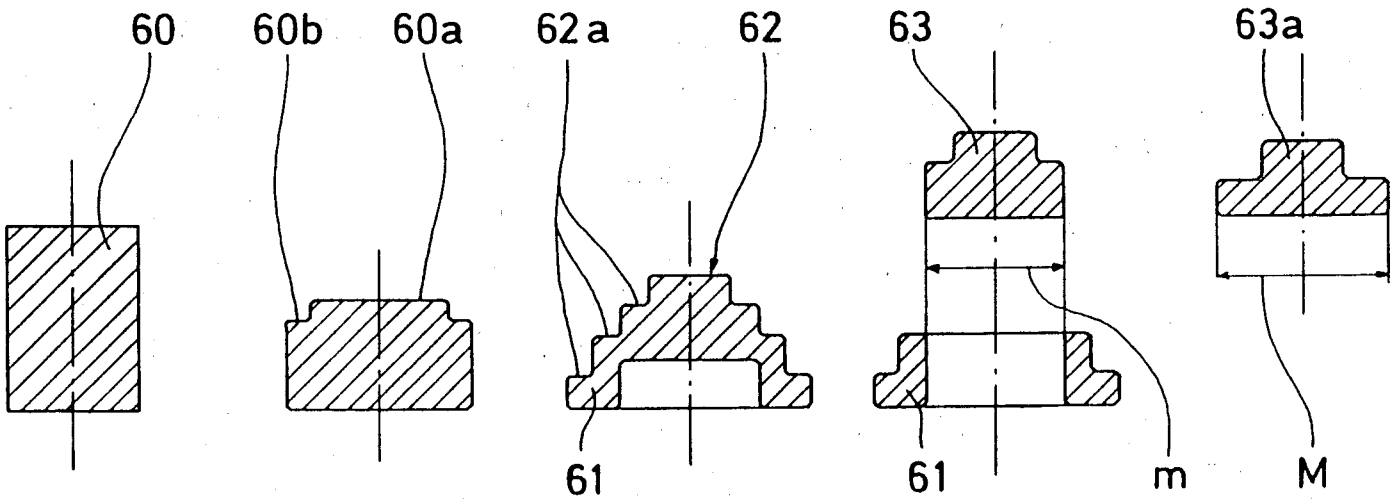
Figure 6:
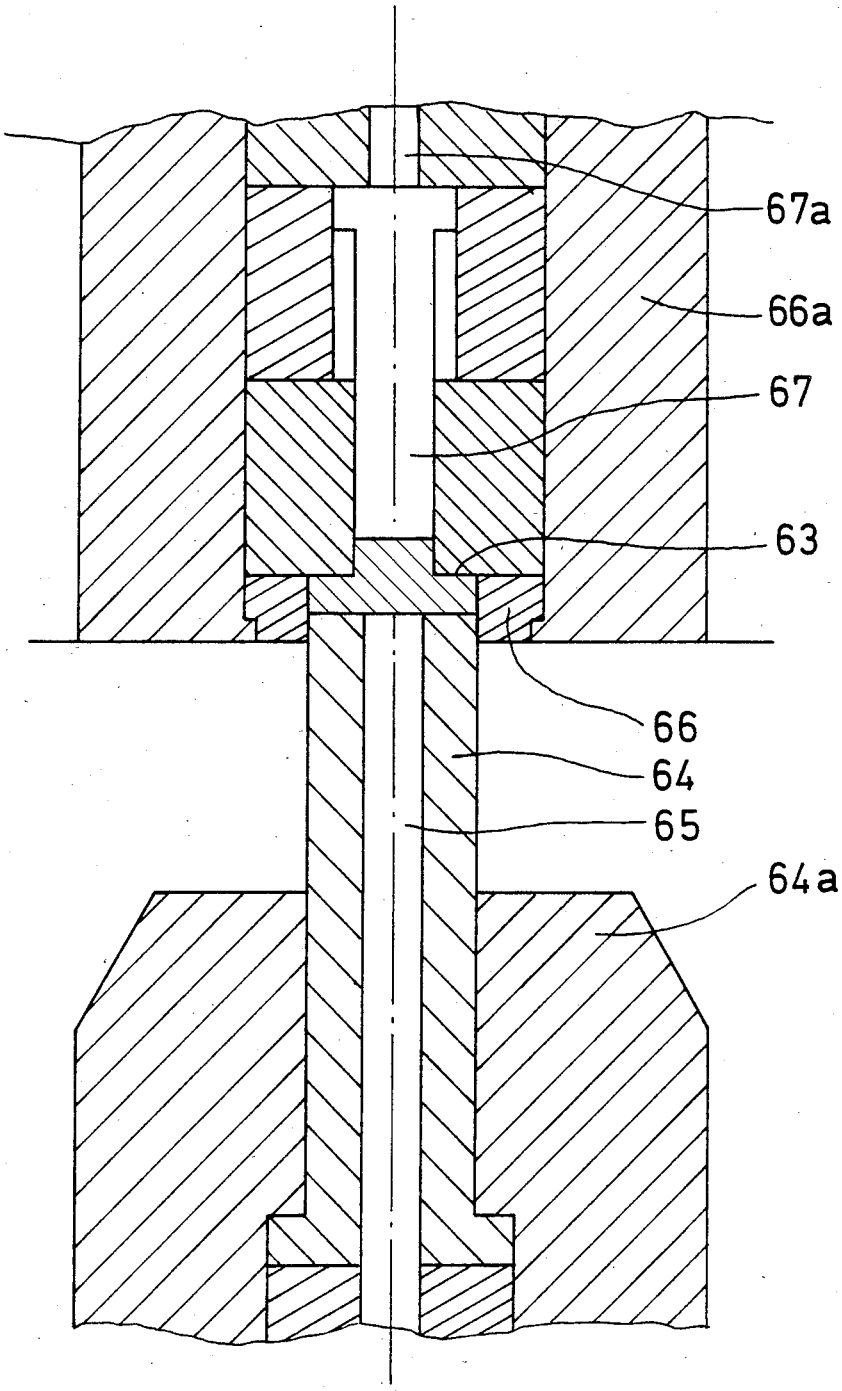

FIG. 1 is a simplified sectional representation, in partial cross section, through the tool region of a four-stage hot-forming press, FIGS. *2a* through *2e* illustrate, in cross section the forming, in stages, of a pressed article which is only stamped in the fourth stage, FIGS. *3e* through *3c* illustrate, in cross section the various forming phases of a pressed article, the fourth working stage being a combined stamping and forming stage, FIG. 4 is a simplified representation, partially in cross section of the fourth forming station for the pressed article shown in FIG. 3, FIGS. *5a* through *5e* illustrate, in cross section, the successive forming phases of a pressed article with pure forming in the fourth station, and FIG. 6 is a simplified representation, in partial cross section, of the fourth forming station for the pressed article shown in FIG. 5.

According to FIG. 1, a bar 1 heated to forging temperature is pushed intermittently, at the work rate of the machine, against a stop 2 by a known material feed device and is sheared off by a shearing knife 3 interacting with a fixed knife 4. At the same time, the sheared-off part is retained by a finger 5 on the shearing knife 3. After being sheared-off, this sheared-off part is brought by the shearing knife 3 in front of the first work station 6 of the forming press which is a four-stage press in this case.

Each of the four work stations has a punch located on a press slide (not shown) moving to and fro, and a die located co-axially opposite this punch and attached fixedly to the machine body 7. In the first working stage of the machine, denoted by 6, the punch is designated by 10 and the die by 9. Within the die 9 there is a movably mounted ejector *9a* connected to a drive (not shown). A retaining pin 8 is mounted movably in a central bore in the punch 10. There is no need to discuss further details of the construction of the machine in the present connection, since, on the one hand, they are not necessary for understanding the idea of the invention and, on the other hand, can be assumed to be known to a person skilled in the art.

During the forward movement of the press slide in the direction of the arrow indicated in FIG. 1, the sheared-off blank is pushed by the resiliently supported retaining pin 8 out of the shearing knife 3 into the die 9 and is retained firmly there until it is pressed by the following punch 10 into the mould defined between the punch 10 and the die 9 and a pre-form 11 is obtained. In the examplary embodiment chosen, this pre-form of the pressed article has the contours of a flat circular cylinder.

In the second working stage, designated generally by 12, the pressed article 11 is further formed between a die 13 and a punch 14, with the goal of ensuring that only a ready-formed outer ring 16 still has to be severed in the following third stage 15. The forming operation of the second stage 12 thus results in a form of the pressed article which corresponds to the third forming phase according to FIG. *2c* and which has an outer ring A, an inner ring J and a radially extending annular web S connecting the two rings to one another. In FIG. *2d*, the outside diameter of the inner ring I is denoted by d and the inside diameter of the outer ring A by D. The radially extending annular web S has an upper annular surface F, the inner radius difference R-r of which is designated by r.

During the forming operation in the third forming stage 15, the resiliently supported retaining pin 17, since it is in its front end position, first comes up against the pressed article 18 held by known cross-transport tongs (not shown) during the forward movement of the press slide, and moves the pressed article against the stamping die 19 until the outer ring 16 rests on the stamping die 19.

As a result of the further forward movement of the press slide, the retaining pin 17 remains stationary in relation to the stamping die 19, the spring 21 being compressed, until the stamping punch 20 comes up against the blank 18 and finally stamps it off. The outer ring 16 is pushed over the stamping punch 20 and remains adhering there, whilst the inner part 22 stamped off remains in the stamping die 19. The press slide is not retracted, and the space in front of the die is made free for the cross-transport device; an ejector pin 23, which is driven by a known mechanism (not shown) pushes the inner stamped-off part 22 out of the stamping die 19 into the tongs of the cross-transport device which are ready for gripping. As soon as the punch device moves outside the cross-transport region, the stamped-off outer ring 16 still adhering to the stamping punch 20 is stripped off from the stamping punch 20 by a stripper sleeve 24. For this purpose, a relative movement in relation to the stamping punch 20 is transmitted by the stripper pin 25 to the stripper sleeve 24 by means of a known drive (not shown). The outer ring 16 falls down and is conveyed away from the press as a finished part.

The inner part 22 is now fed to the last stage 26 by the cross-transport device. Here, this inner part 22 is pushed by a spring pin 27 from the cross-transport device into a die 32 during the forward movement of the press slide, until the bottom of the inner part 22 rests on the annular surface 28 of a bracing device 29. At the same time, the annular web 38 corresponds to the radial annular web S in FIG. *2c* is located in an appropriately shaped and dimensioned depression 31 of the die 32, since at this moment the bracing device 29 is in its forward position. The spring pin 27 remains stationary during the further forward movement of the press slide, and the stamping punch 33 reaches the bottom 34 of the inner part 22 and stamps out a waste piece 35 which is ejected by the spring pin 27 through the orifice 36 in the rear part of the die. Then, the bracing device 29, controlled by a cam (not shown), moves away to the rear, with the result that the stamping-punch sleeve 37 stamps out a ring 38 located in the depression 31 of the die 32.

It should be noted especially, here, that in the last working stage 26 of the machine the radial annular web S (FIG. *2c*) rests, in the form of a flange 38 projecting freely outwards, on the supporting surface of the die depression 31 with its entire cross-section. This annular web 38, the cross-sectional surface of which corresponds to the annular surface denoted by $\Delta r$ in FIG. *2c*, can be practically as thin as desired, reliable shearing-off still being guaranteed in any case. In particular, there is no need to provide a movably mounted inner-ring die which supports this annular web 38 during the shearing-off operation and the wall thickness of which would have to be adapted to the cross-section of the annular web 38. Thus, the annular web 38 is in any case, that is to say even when it has a large outside diameter, supported on a solid firmly anchored supporting member, namely the die 32. As a result, the annular web is supported securely during the shearing-off operation and deformation, especially twisting or tilting thereof, is prevented.

When the punch moves back, the stamped-off ring 38 remains adhering to the outer surface of the stamping-punch sleeve 37. It is stripped off from the stamping-punch sleeve 37 by a fixed stripper 39 and is ejected from the machine. The remainder 22*a* of the inner part 22 remains adhering to the stamping-punch 33. During the return of the punch, via a known drive (not shown) which by means of ejector pins 40 displaces the stamping-punch sleeve 37 forward so as to slide on the stamping punch 33, this remainder is stripped off from the stamping punch 33 and allowed to fall, then to be ejected from the machine. By means of this operation, the individual parts are separated very cleanly from one another.

Thus, as shown in FIGS. 2*a* through 2*e*, this process starts from a bar which is heated to forging temperature and from which a blank 41 is sheared-off. This is upset, in the first forming stage, into a cake-like shape 42. In the following forming stage, the form denoted by 43, which has the two co-axial rings J and A with the radially extending annular web S, is already produced. In the third stage, an outer ring 44 is sheared-off and ejected as a finished part, whilst the inner part 45 is transported further to the fourth stage where another stamping operation takes place.

A further possibility of forming by means of the four-stage machine illustrated in FIG. 1 is shown diagrammatically in FIGS. 3*a* through 3*e*. Again, this starts from a bar which is heated to forging temperature and from which a blank 46 is sheared-off and pressed, in a first stage, into a cake-like shape 47. In the second working stage of the machine, the pressed article is formed in such a way that, again, an outer ring 48 and an inner ring 49 arranged co-axially to ring 48 are obtained, both of these being connected to one another by a radial annular web S. The outer ring 48 has reached its final outer shape after the completion of this second forming stage, whilst the inner ring 49 has not yet attained its finished form. The following third stage is, again, a stamping stage in which the outer ring 48 is stamped off from the inner part 49 and ejected. Here too, the outer ring 48 is to be considered as a finished part in terms of the process described. In the fourth stage, the inner part 49 is perforated and additionally given its final form, the inner ring 50 being upset to a larger outside diameter M than the inside diameter m of the hole in the outer ring 48 obtained by means of a stamping operation.

Thus, whereas in known processes the dimensions of the inner ring are fixed once it has been sheared-off, the process described makes it possible, in the last working stage of the machine, to subject the inner ring to further working which can involve, in particular, perforation and/or forming.

FIG. 4 shows this combined stamping and forming operation carried out in the last stage according to FIGS. 3*a* through 3*e*. Here again, a die 53 located opposite a co-axial punch mounted to move to and fro is arranged in a fixed die holder 53*a*. In the present case, this punch has a stamping punch 55 on the periphery of which a forming punch 59 is mounted movably. During the forward movement of the punch designated by 51, the inner part 49 (FIG. 3*a*) is pushed by a spring pin 52 out of the tongs of the cross-transport device into the die 53 until the part to be processed rests on an ejector sleeve 54 of the die. The following stamping punch 55 first stamps out the waste piece 56, and subsequently the shearing gap between the stamping punch 55 and the ejector sleeve 54, serving at the same time as a stamping die, is closed by the partial conical form 55*a* of the stamping-punch 55; the following forming punch 59 closes the shaping die 53 and the ring 50 thus undergoes further forming. The waste piece 56 falls out of the mould through an orifice 58. During the return movement of the punch, the formed ring 50 is ejected by the ejector sleeve 54 or, if it remains adhering to the stamping punch 55, is stripped off from the forming punch 55 by the forming punch 59 serving as a punch ejector sleeve as a result of axial relative displacement.

FIGS. 5*a* through 5*e* show a further possibility for a forming operation, likewise based on the process according to the application. The starting material is, again, a preheated bar from which a blank 60 is sheared-off. In a first stage, this is given the preform denoted by 60*a*, which has in its upper part an annular shoulder 60*b*. In the following second stage, the pressed article is given a form which has three staggered annular shoulders 62*a* on its periphery. The pressed article, denoted here generally by 62, has at the end of this second forming stage a lower portion 61 which already possesses the finished contours of the outer ring to be produced. In the following third stage, this lower outer ring therefore only has to be stamped off and ejected. The remaining inner part 63 is then transported into the fourth working stage and is given the final form denoted by 63*a*. FIG. 5*e* shows clearly that this final form has a larger outside diameter than the inner part 63 stamped out in the preceding working stage.

The construction of this last working stage which produces results according to FIG. 5*e* is illustrated by the diagrammatic representation in FIG. 6. Again, a die 66 is arranged fixedly in a die holder 66*a*. The punch located co-axially opposite is fastened in a punch holder 64*a* in a known way and consists of a forming punch 64 in which an ejector 65 is mounted so as to move co-axially. Also located in the die holder is an ejector 67 which is on the same side as the die and which is coupled via a bar 67*a* to a drive (not shown). The further details of the construction of this embodiment may be assumed to be known to a person skilled in the art.

In addition to the advantages mentioned already, it is shown that by means of the process described a saving of material can also be achieved, since the forgings can be combined. Thus, it is posssible, for example, to design the ring designated by 38 in FIG. 2 so that even this can still be utilised.

To avoid misunderstandings, it should be pointed out expressly that in the present connection the term "ring" embraces not only circular, but also polygonal, for example, square annular bodies.

I claim:

1. A process for producing at least two forgings in a multistage work cycle on a hot-forming press by means of cooperating punch and die members including the steps of producing a pressed article which has at least two coaxial parts connected to one another by a radially extending annular web, said parts being an inner part and an outer part, of which at least the outer part, having the greater outside diameter, is annular, and the inner part is cup-shaped with a closed end, severing the parts from one another in the region of the annular web by shearing, whereby said severing comprises serving first the outer part in a first severing-processing state at a predetermined first annular separating interface which cuts through the radial annular web and leaves a remaining radially extending annular web connected to the inner part and then ejecting the outer part as a finished part; whereafter transporting the inner part having a closed end, including said remaining radial annular web section still attached to it into a second severing-processing stage, in which at said second severing-processing stages comprises:

punching out the centrally located closed end of the inner part to form a hollow annular inner part and ejecting the closed end as a waste piece, severing the remaining radial annular web section from the inner part at a predetermined second annular separating interface which cuts through the web section, by contacting the entire face which defines the remaining radially extending annular web section with a corresponding annular supporting surface provided at the front of a die member as the remaining radial annular web is severed therefrom to form a cut-off web, and moving said punch along a direction of travel to eject the cut-off web section separately from the hollow annular inner part and further eject the annular inner part along said direction of travel of the punch member.

2. In a hot forming press having cooperating punch and die members, and apparatus for producing at least two forgings in a multi-stage work cycle from a pressed article which has at least two co-axial parts connected to one another by a radially extending annular web (38), said parts being an inner part (22*a*) and an outer part (16), the apparatus comprising in each stage, a punch mounted for reciprocation with respect to a stationary die located co-axially opposite said punch, the punch having, in a first severing processing stage (15), an inner stamping punch (20) mounted coaxially and movably with respect to said punch, a stripper sleeve (24) mounted to slide on a peripheral surface of the stamping punch (20), and a spring biased inner retaining pin (17) mounted within the inner stamping punch (20) and movably mounted relative thereto, wherein motion of the retaining pin (17), the stamping punch (20) and the stripper sleeve (24) are coordinated with one another so that in the first severing processing stage only, the annular outer part (16) is severed and then ejected as a finished part, further comprising in a second severing processing stage (26) at the stationary die (32), an annular supporting surface (31) for supporting a section of said radially extending annular web (38) attached to the inner part (22*a*) and a movable bracing device (29), having a ring surface (28) corresponding to the outer diameter of said inner part (22*a*), said annular supporting surface (31) being located on said stationary die (32) and said movable bracing device (29) being positioned within said stationary die (32), the punch of said second severing processing stage (26) being provided within an inner punch stamper (33) and in its operating front face with a retaining spring biased pin (27) for pushing said inner part (22*a*) into said stationary die (32) and against said ring surface (28) as well as a waste piece (35) of the article into the die for ejection after it has been severed from said innner part (22*a*) by said inner punch stamper (33), said inner punch stamper (33) cooperating with said movable bracing device (29) to effect said severing, and being further provided with a stamping punch sleeve (37) mounted to slide on a peripheral surface of said punch stamper (33), having an outer diameter also corresponding to the outer diameter of said inner part (22*a*) and cooperable with said annular support surface (31), whereby the motions of said bracing device (29) and said punch sleeve (37) are coordinated with one another so that the section of said web (38) is severed by said punch sleeve (37) and said annular supporting surface (31) and the motions of said punch stamper (33) and said punch sleeve (37) are coordinated to one another so that said inner part (22*a*) is stripped off by said sleeve from said punch, and being finally provided with a stripper (39) for stripping off said web from said punch sleeve (37) and said first and second stages being located adjacent each other with means for moving said inner part (22*a*) and its web (38) from said first stage to said second stage.

* * * * *